US005921904A

United States Patent [19]

Toups

[11] Patent Number: 5,921,904

[45] Date of Patent: Jul. 13, 1999

[54] PORTABLE INCLIMETRIC RESISTANCE EXERCISE DEVICE

[76] Inventor: Lanny J. Toups, 338 Meadowcreek Dr., Duncanville, Tex. 75137

[21] Appl. No.: 09/039,449

[22] Filed: Mar. 16, 1998

[51] Int. Cl.[6] ..... A63B 23/02

[52] U.S. Cl. ..... 482/140; 482/127; 482/121; 482/125

[58] Field of Search ..... 482/121–123, 482/124, 127, 133, 72, 132, 140, 130

[56] References Cited

U.S. PATENT DOCUMENTS

| | | | |
|---|---|---|---|
| 5,224,914 | 7/1993 | Friedman | 482/140 |
| 5,669,861 | 9/1997 | Toups | 482/98 |
| 5,669,862 | 9/1997 | Sayman | 482/127 |
| 5,759,138 | 6/1998 | Boland | 482/122 |
| 5,772,562 | 6/1998 | Stevens | 482/140 |
| 5,772,563 | 6/1998 | Lin | 482/140 |
| 5,776,042 | 7/1998 | Szabo | 482/140 |
| 5,779,607 | 7/1998 | Harris | 482/140 |

*Primary Examiner*—Jerome Donnelly
*Attorney, Agent, or Firm*—John E. Vandigriff

[57] ABSTRACT

The invention is a portable exercise device which creates a controlled and infinitely variable resistance profile. The exercise device, creates this infinitely variable resistance using springs or elastic bands to create the input resistance versus the use of a weight stack as normally used in most exercise equipment. The advantage of this device over conventional exercise devices is that usage of this resistance medium creates a portable exercise device that can create an infinitely variable resistance profile. The exercise devise may be used while traveling and/or in the home. The ease with which the input resistance elements, such as elastic bands or springs, may be changed makes this device much more versatile for exercising a wider range of muscle groups while using one portable machine.

11 Claims, 3 Drawing Sheets

PORTABLE INCLIMETRIC RESISTANCE EXERCISE DEVICE

FIELD OF THE INVENTION

This invention relates to exercise devices, and more particularly to a portable inclimetric resistance exercise device.

CROSS-REFERENCE

U.S. Pat. No. 5,669,861, titled, "Incline Resistance Weight Unit for Exercise Machine.

BACKGROUND OF THE INVENTION

Non-portable Exercise machines generally have as a weight element a plurality of weights that are stacked with a pair of parallel bars extending through the weights to keep them stacked and to provide a vertical path for the weights. A third rod extends down through the stacked weights and has a row of holes extending through the rods corresponding to holes in the weights. By inserting a pin into a hole in a weight and through to a corresponding pin in the third rod, all weights above the weight into which the pin is inserted will be the weights that are to be lifted. The weights are connected by cables and pulleys to one of several handles or pedals that are pushed with the feet or grasped by the hands to lift the weights. Machines utilizing such weight apparatus are heavy and only the exact amount of weight in the stack of weights is available for use.

Portable exercise devices usually have two handles connected by springs or elastic devices to provide the resistance for moving the two handles together or apart. The resistance provide by a simple spring or elastic band is constant and does not vary.

In other examples of portable or hand held exercise devices, the device may consist of a simple weight.

SUMMARY OF THE INVENTION

The invention is a portable exercise device which creates a controlled and infinitely variable resistance profile much the same as the Incline Resistance Weight Unit described in U.S. Pat. No. 5,669,861. This unit, however, creates this infinitely variable resistance using springs or elastic bands to create the input resistance versus the use of a weight stack as described in U.S. Pat. No. 5,669,861. The advantage of this concept over the aforementioned patent is that usage of this resistance medium creates a portable exercise device that can create an infinitely variable resistance profile as described using the same principles of physics that apply to U.S. Pat. No. 5,669,861. The exercise devise may be used while traveling and/or in the home. The ease with which the input resistance elements, such as elastic bands or springs, may be changed makes this device much more versatile for exercising a wider range of muscle groups while using one portable machine.

DESCRIPTION OF A PREFERRED EMBODIMENT

Figure 1:
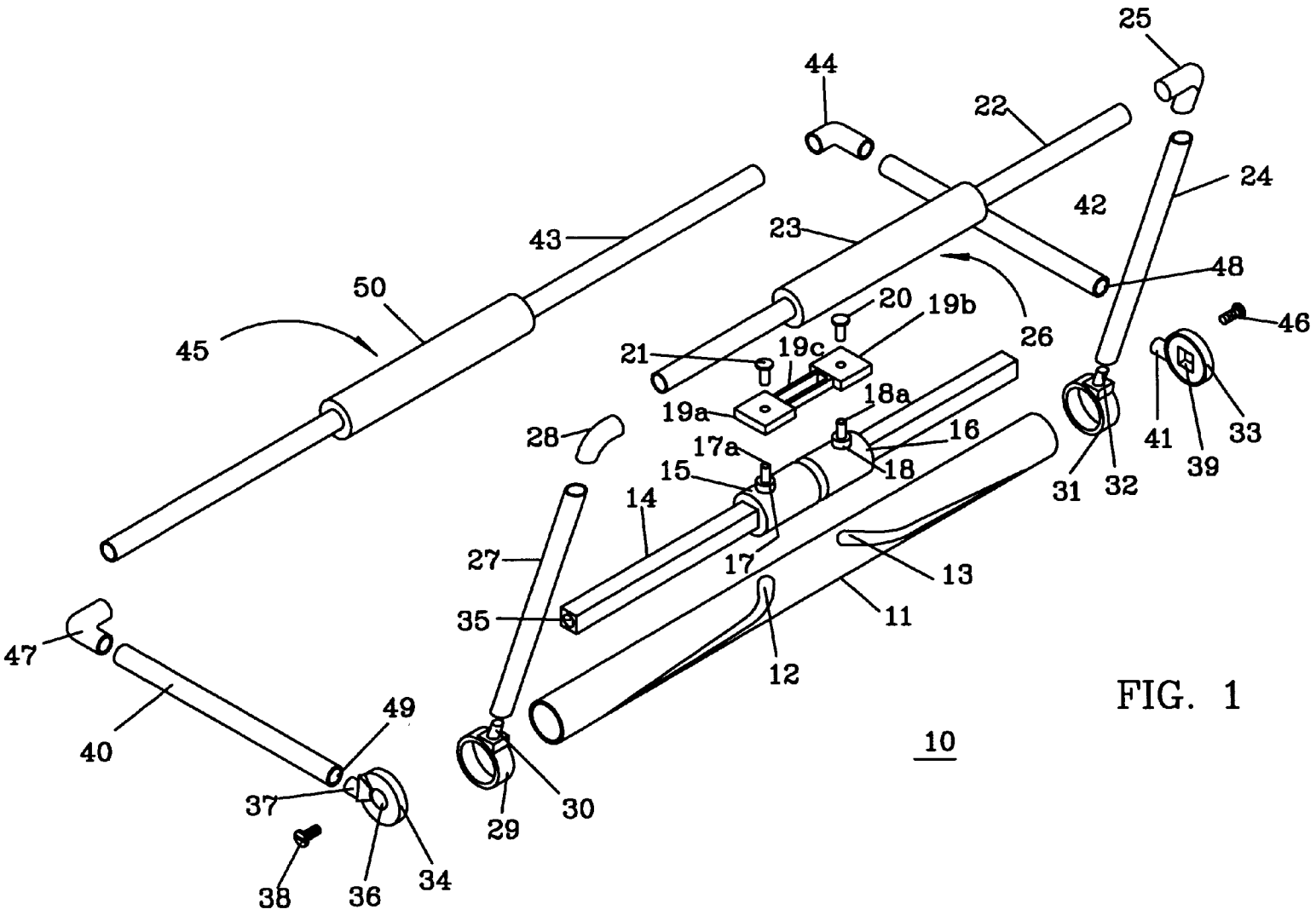
FIG. 1 is an exploded view of the portable exercise machine.

FIG. 1 is an exploded view of the portable exercise machine 10 showing the parts that make up the portable exercise machine. The exercise machine has two handle assemblies 26 and 45, first handle assembly 26 is made up of side bars 24 and 27 which are connected to the hand bar 22 by elbows 25 and 28, respectively. Hand bar 22 may have a padded hand grip 23 which may be, for example, a foam rubber cylinder position in the mid section of hand bar 22.

Second handle assembly 45 is made up of side bars 40 and 42 and are connected to handle bar 43 by elbows 44 and 47, respectively. Handle bar 43 may have a padded hand grip 50.

The first handle assembly 26 is connected to two sleeves 29 and 31 that are attached to a cylinder 11 which has two grooves or slots 12 and 13. For example, handle side bar 24 is connected to sleeve 31 by pin 32, and handle side bar 27 is connected to sleeve 29 by pin 30. Each of sleeves 29 and 31 is mounted on an opposite end of cylinder 11. Sleeves 29 and 31 may be permanently secured to cylinder 11 by welding or may be swedge fitted.

Slider bar 14 (FIG. 1) has two cylindrical slides 15 and 16 mounted thereon. Slider bar may be square or some other polygonal shape, for example square, hexagonal, or octagonal so that slide 15 and 16 may move in and out in an axial direction on slider bar 14, but rotate with the slider bar when it is rotated. Slider bar 14 and cylindrical slides 15 and 16 are inserted in cylinder 11. After the insertion of slider bar 14 and cylindrical slides 15 and 16 into cylinder 11, bearings 17 and 18, mounted on studs 17*a* and 18*a*, respectively, are secured, one each to slide 15 and 16. An elastic or rubber band 19, made up of parts 19*a*, 19*b* and 19*c* is mounted on studs 17*a* and 18*a*. End 19*a* is mounted on stud 17*a* and band end 19*b* is mounted on stud 17*b*. Band ends 19*a* and 19*b* are attached together by elastic straps 19*c*.

Bearing 17 and stud 17*a* and band end 19*a* are secured to slider 17, through groove 12 in cylinder 11. Bearing 18, stud 18*a* and band end 19*b* are secured to slider 16 through groove 13.

After inserting slider bar 14 and sliders 15 and 16 into cylinder 11, retaining plates 33 and 34 are attached to the opposite ends of cylinder 11 and slider bar 14 by screws 46 and 38, respectively. Each of retaining plates 33 and 34 has a polygonal recess that receives slider bar 14. For example, retaining plate 33 is illustrated having a square recess 39. However, recess 39 may also be one of hexagonal or octagonal. Second handle assembly 45, is then attached to retaining plates 33 and 34 by pins 41 and 37, respectively. The spacing between the two handle assemblies is dependent upon the number of sides of slider bar 14. The larger number of sides of slider bar 14, the larger number of positions that the two handles may be positioned in relation to each other.

Figure 2:
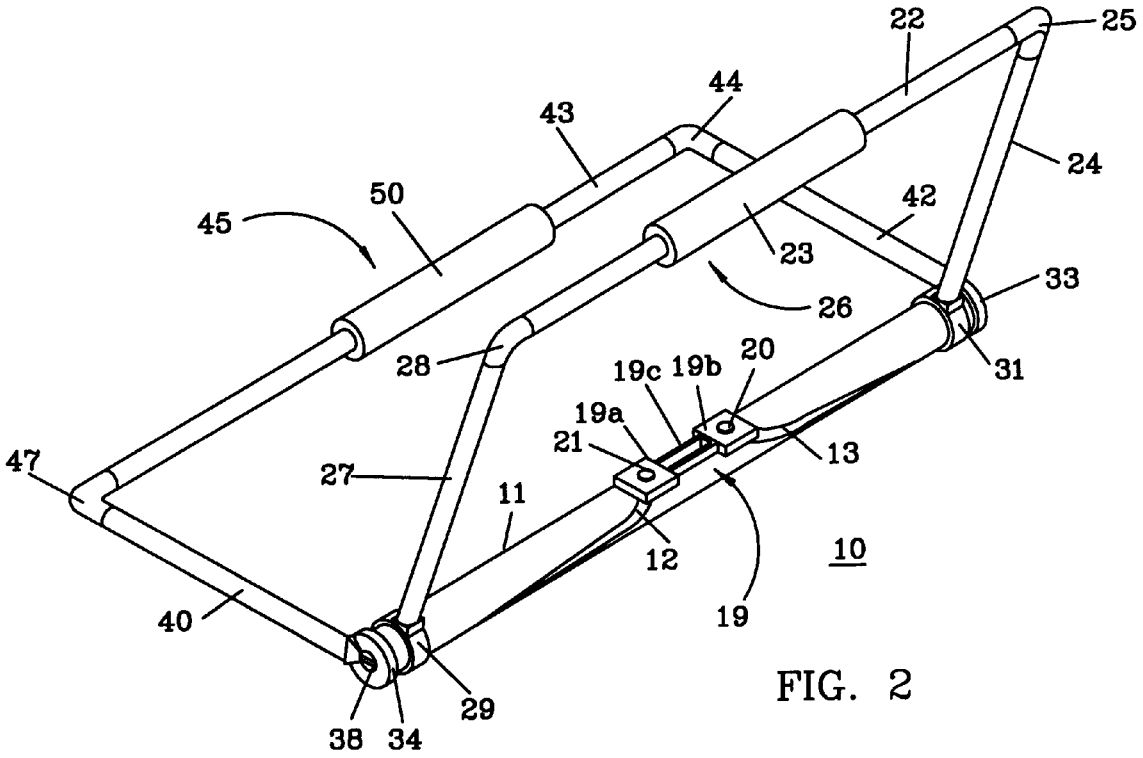
FIG. 2 is an isometric view of the portable exercise machine.

FIG. 2 shows the portable exercise machine 10 assembled. Handle assembly 26 is rigidly attached to cylinder 11 by sleeves 29 and 31. Handle assembly 45 is attached to slider bar 14 by screws 38 and 46 which extend through retaining plates 34 and 33, respectively. Retaining plates 33 and 34 rotate freely at the end of cylinder 11. When handle assembly 45 is moved toward and away from handle assembly 26, retaining plates 33 and 34 rotate slider bar 14 inside cylinder 11. When slider bar 14 is rotated, slides 15 and 16 rotate with it. Since bearings 17 and 18 are in grooves 12 and 13, respectively, as slider bar 14 and slides 15 and 16 rotate, bearings 17 and 18, as well as studs 17*a* and 18*a* are moved apart, following the paths of grooves 12 and 13. Movement of bearings 17 and 18, and studs 17*a* and 18*a* are restrained by elastic band 19. This results from the fact that band end 19*a* is attached to stud 17*a*, and end band end 19*b* is attached to stud 18*a*. Band 19 may be a one piece band as illustrated with the central portion 19*c* being an integral part of band 19 along with the ends 19*a* and 19*b*. In another embodiment, the central portion 19*c* of band 19 may be one or more springs attached to ends 19*a* and 19*b*.

Figure 3:
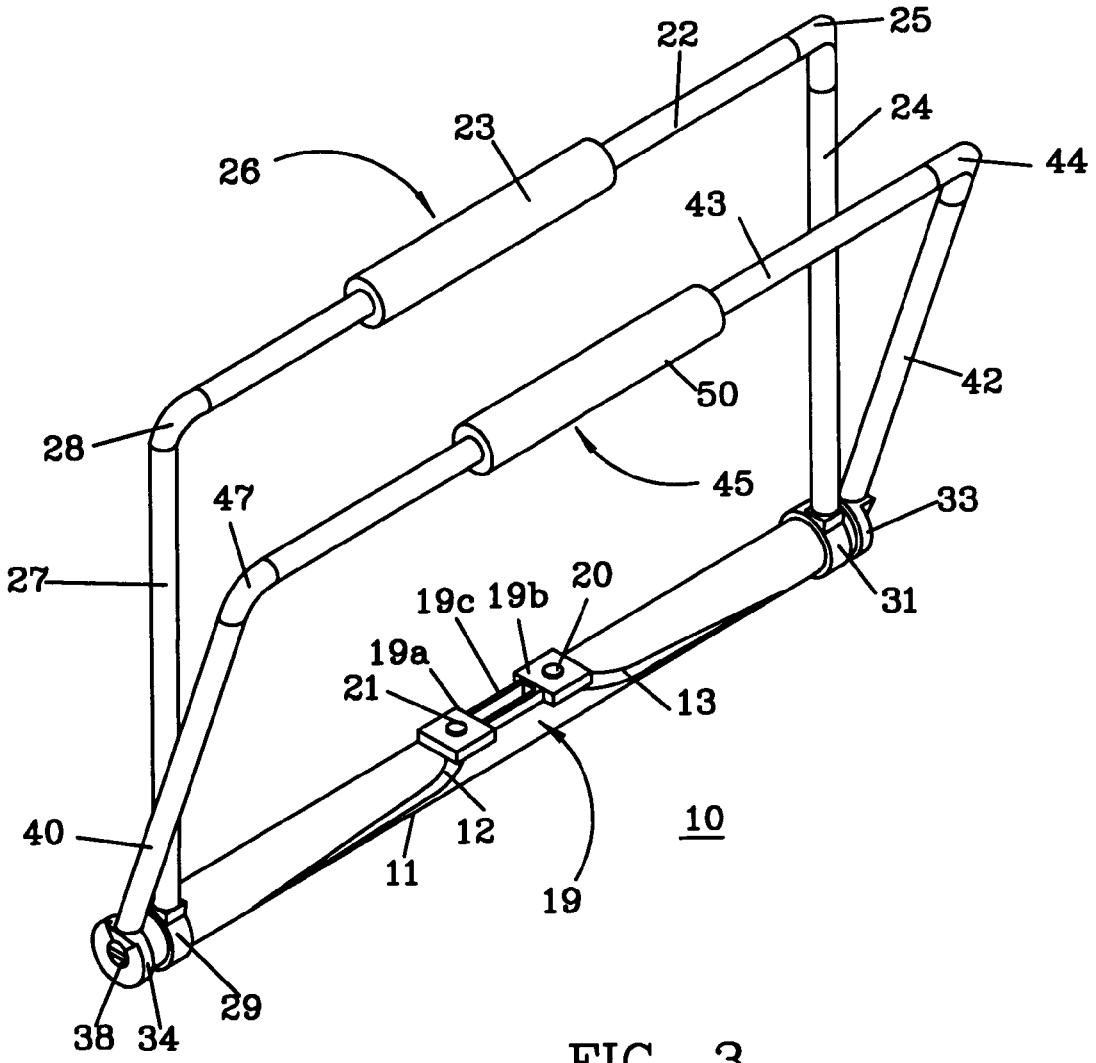
FIG. 3 is an isometric of the a different configuration of the portable exercise machine.

FIG. 3 illustrates a second configuration of the portable exercise device 10. In this configuration, handle assembly 45 is mounted to the right, as viewed in FIG. 3, of handle assembly 26. This is opposite from the configuration shown in FIG. 2. In FIG. 2, the two handle assemblies 26 and 45 are pulled toward each other. In the configuration of FIG. 3, the two handle assemblies 26 and 45 are pulled away from each other. Handle assembly 45 has been moved to the right of handle assembly 26 by removing screws 38 and 46(FIG. 2) and retaining plates 33 and 34, and reassembling handle 45 on the right side of handle assembly 26. The distance between the reassembled handle assemblies 26 and 45 will depend upon the number of sides of slider bar 14.

The operation of portable exercise devices is as follows. When handle unit 45 and handle unit 23 are rotated toward each other, the grooves or slots 12 and 13 cause sliders 15 and 16, respectively, to move away from each other thereby stretching rubber band 19. Slots 12 and 13, because of the varying pitch of the slots in relation to the longitudinal axis of cylinder unit 11, causes a varying resistance profile that is felt at the handles 26 and 45 even though the resistance force from the rubber band unit 19 is fixed. The varying pitch of the slot in relation to the longitudinal axis of sleeve 11 uses the same concepts of Physics to create the varying resistance felt at the handles as is achieved by the exercise device described in U.S. Pat. No. 5,669,861. The difference between the two being that the slot that creates the resistance in the present device is machined into the outer device as opposed to the inner device ass described in U.S. Pat. No. 5,669,861. The operation in the same for the configuration of FIG. 3, except the handle assemblies are pulled apart from each other.

Device 10 has the capability to produce an infinitely varying resistance profile without the requirement to have weight plates mounted upon it. It also has the potential for mounting as many as three pairs of slots positioned around cylinder 11 and attaching additional rubber bands in the same manner as band 19 is attached to sliders 15 and 16. Device 10 is portable and has the capability to exercise more than one muscle group using several different sized rubber bands or springs that create, or add to the resistance profile.

What is claimed:

1. A portable exercise apparatus, comprising:

a cylinder unit having at least two varying pitch slots;

a slider bar having two slides thereon rotatably mounted inside said cylinder unit, each slide having a pin extending through said varying pitch slots;

a first handle assembly attached to said cylinder unit;

a second handle assembly attached to said slider bar; and an elastic band attached between pins on said two slides;

wherein when said two handle assemblies are moved toward each other, said elastic band and the movement of said pins in said varying pitch slots provides an inclimetric resistance to the movement of the handle units.

2. The portable exercise apparatus according to claim 1, including a roller bearing on each of said pins to providing rolling movement of the pins in said slots.

3. The portable exercise apparatus according to claim 1, wherein said slides slide along said slider bar, in opposite directions, as said handle assembles are moved toward or away from each other.

4. The portable exercise apparatus according to claim 1, wherein one of the springs and elastic bands are secured between said pins on said slides.

5. The portable exercise apparatus according to claim 1, wherein each of said slots spiral around said cylinder with a slope that varies in relation to longitudinal axis of the cylinder.

6. The portable exercise apparatus according to claim 1, wherein said slider bar is a multi-sided bar to allow for varying the spacing between the first and second handle assemblies.

7. A portable exercise apparatus, comprising:

a cylinder unit having at least two varying pitch slots, each of said slots spiraling around said cylinder with a varying slope;

a slider bar having two slides thereon mounted rotatably mounted inside said cylinder unit, each slide having a pin extending through said varying pitch slots;

a first handle assembly attached to said cylinder unit;

a second handle assembly attached to said slider bar; and an elastic band attached between pins on said two slides;

wherein when said two handle assemblies are moved toward each other, said elastic band and the movement of said pins in said varying pitch slots provides an inclimetric resistance to the movement of the handle units.

8. The portable exercise apparatus according to claim 7, including a roller bearing on each of said pins to providing rolling movement of the pins in said slots.

9. The portable exercise apparatus according to claim 7, wherein said slides slide along said slider bar moves away from and toward each other as said handle assembles are moved away from and toward each other.

10. The portable exercise apparatus according to claim 7, wherein at least one of springs and elastic bands are secured between said pins on said slides.

11. The portable exercise apparatus according to claim 7, wherein said slider bar is a multi-sided bar to allow for varying the spacing between the first and second handle assemblies.

* * * * *